United States Patent [19]

Cheng

[11] Patent Number: 4,693,695

[45] Date of Patent: Sep. 15, 1987

[54] ASCENDING AND DESCENDING BALLOON ACTION TOY

[76] Inventor: Peter S. C. Cheng, 5 Ross Street, Toronto, Ontario, Canada, M5T 1Z8

[21] Appl. No.: 846,055

[22] Filed: Mar. 31, 1986

[51] Int. Cl.[4] ..... A63H 27/10

[52] U.S. Cl. ..... 446/220; 446/250

[58] Field of Search ..... 446/220, 221, 225, 250

[56] References Cited

U.S. PATENT DOCUMENTS 600,967 3/1898 Mead ..... 446/220

2,864,201 12/1958 Leise ..... 446/220 X 4,130,962 12/1978 Ennis ..... 446/250

FOREIGN PATENT DOCUMENTS 0081899 6/1983 European Pat. Off. ..... 446/220

*Primary Examiner*—Kenneth Downey

*Attorney, Agent, or Firm*—Kirschstein, Kirschstein, Ottinger & Israel

[57] ABSTRACT

An ascending and descending balloon action toy includes an envelope filled with a lighter-then-air gas, the envelope repeatedly ascending and alternately descending a tether.

9 Claims, 5 Drawing Figures

ASCENDING AND DESCENDING BALLOON ACTION TOY

BACKGROUND OF THE INVENTION

1. Field of the Invention

This invention generally relates to lighter-than-air balloons and, more particularly, to an action toy having a helium-containing-gas-inflated envelope which alternately and repeatedly ascends and descends a tether during play.

2. Description of the Prior Art

Lighter-than-air balloons for toy or advertising purposes were conventionally made for many years by filling an envelope comprised of an elastomeric material with a helium-containing gas at fairs, shopping centers, circuses, restaurants, parks and the like, where helium was available to fill the balloons shortly before use or sale. However, such balloons invariably lost their buoyancy within a few hours or days as a result of helium losses by diffusion through the elastomeric material.

In order to extend the limited lifetime of such balloons, many composite envelope materials have heretofore been proposed which were relatively impermeable to gases to various degrees. One particularly long-lasting balloon of the so-called foil-seal type was described in U.S. Pat. No. 4,077,588 wherein non-elastomeric polymer sheets coated with a continuous metal layer were used in the construction of the envelope material.

It was also known to fill both elastomeric and foil-seal type balloons with air or helium-containing gases, and to tie such balloons to one end of a string, elastic cord or analogous tether. The other end of the tether was held in one's hand to carry the balloon from place to place. As described, for example, in U.S. Pat. No. 600,967, a rebounding balloon tied to an elastic tether provided more active amusement by permitting the user to bounce the balloon repeatedly off his or her hand. U.S. Pat. No. 2,722,775 disclosed a tethered balloon toy which provided amusement by having a user release an inflated balloon for outward travel away from the user, the balloon being returned to the user by virtue of the unwinding of a pair of rubberbands that initially became twisted and stored energy during the outward travel. U.S. Pat. No. 3,310,024 disclosed a helium-filled balloon tethered to a reel and used as a signal to indicate the location of a person in distress. U.S. Pat. No. 3,881,531 disclosed still another tethered gas-filled balloon used as a signal device. Other types of balloon toys were disclosed in U.S. Pat. Nos. 3,879,887 and 2,008,552.

Although balloon toys have entertained countless numbers of children and adults over many years, they have not proven to be altogether satisfactory. This has been due, in part, to the limited lifetime of those balloons having elastomeric envelopes. This has also been due to the limited active play value involved in merely carrying or rebounding a balloon off one's hand.

SUMMARY OF THE INVENTION

1. Purposes of the Invention

It is a general object of this invention to overcome the aforementioned drawbacks of the prior art balloon toys.

It is another object of this invention to provide a balloon toy which is fun to play with over a long lifetime.

It is still another object of this invention to increase the active play value of such balloon toys.

It is a further object of this invention to provide such a balloon toy which requires manipulative skills to operate so as to ensure many hours of entertainment reward, creativity and exercise.

Yet another object of this invention is to provide such a balloon which is durable in construction, inexpensive to manufacture, long lasting in use and attractive in appearance.

2. Features of the Invention

In keeping with these objects, and others which will become apparent hereinafter, one feature of this invention resides, briefly stated, in an ascending and descending balloon action toy which comprises an air-buoyant envelope, a spool, and a tether operatively connected to the spool. The envelope has an attached pair of balloon portions mutually symmetrically arranged. Each balloon portion has an interior filled with a lighter-than-air gas, e.g. a helium-containing gas, at about atmospheric pressure.

The spool defines an axis between the balloon portions. A fastening end region of the tether is operatively connected to the spool. An opposite handle end region of the tether is held by a user during play. Intermediate the end regions of the tether, a tether region is repeatably coilable around and uncoilable from the spool during play. More particularly, the tether region is uncoiled from the spool about the axis when the envelope is released by the user into the air so as to enable ascent of the envelope. The tether region coils around the spool about the axis when the handle end region of the tether is yanked by the user so as to cause descent of the envelope.

In further accordance with this invention, each balloon portion is composed of two attached panels. Each panel is comprised of a non-elastomeric polymer sheet having a continuors metallic coating on one side of the respective sheet. The panels are attached to form each balloon portion by continuous seals along peripheral regions of each balloon portion. The resultant envelope is thereby rendered substantially gas-impermeable and substantially permanently air-buoyant.

The spool itself is constituted by an annular seal formed at the interconnection of the balloon portions. The spool bounds an interior which communicates with the interiors of both balloon portions. Hence, the envelope has a common interior in which the helium-containing gas is free to pass from one balloon portion to the other through the spool.

The spool includes a pair of juxtaposed sealing discs, each comprised of a non-elastomeric polymer sheet coated with a continuous metallic coating. The metallic coating of one of the discs faces, and is continuously sealed along an inner annulus to, the metallic coating of the other of the discs. Each metallic coating of a respective disc faces, and is continuously sealed along an outer annulus to, a respective metallic coating provided on an inner side of a respective polymer sheet of one of the panels of each balloon portion.

It is further advantageous if a band, e.g. an elastic rubberband, encircles the spool. The band serves as a convenient mounting structure to which the fastening end region of the tether is tied.

One or more filling nozzles are provided on the envelope. The lighter-than-air gas is introduced into the envelope through such filling nozzles. Once the filling is completed, the nozzles are advantageously closed so as to prevent escape of the gas to the exterior atmosphere.

The balloon action toy of this invention, in effect, climbs up and climbs down the tether in a manner related to the action of the ever-popular yo-yo toy. The ascending and descending action of this toy is performed by rather simple manipulative skills on the part of the user and, hence, can provide many hours of rich entertainment. This toy is fun to play with and long lasting in use.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENTS

Figure 1:
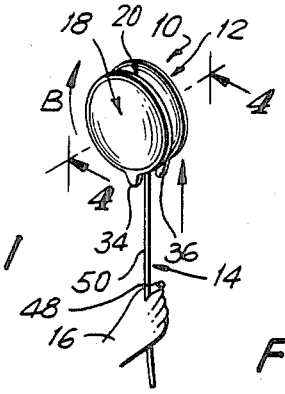
FIG. 1 is a perspective view of the balloon in accordance with this invention during ascent.
Figure 2:
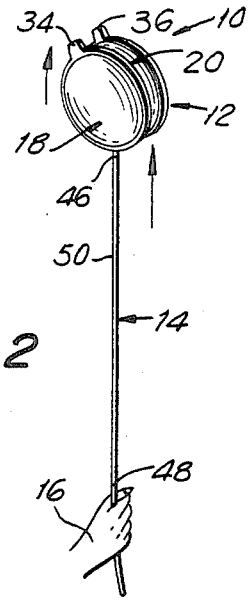
FIG. 2 is a view analogous to FIG. 1, but showing the balloon at the highest level of ascent.
Figure 3:
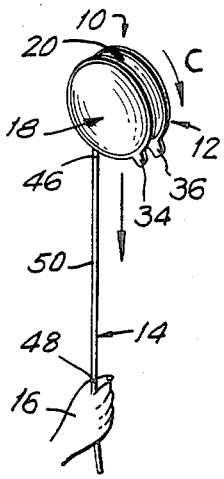
FIG. 3 is a view analogous to FIG. 1, but showing the balloon during descent.

Referring now to the drawings, reference numeral 10 generally identifies the ascending and descending balloon action toy of this invention. The toy 10 comprises an air-buoyant envelope 12, and a tether 14 operatively connected to the envelope. As described in detail below, the envelope 12 ascends the tether 14 as shown in FIG. 1 during an ascending mode of operation until it reaches its highest level of ascent as shown in FIG. 2. Thereupon, the envelope 12 descends the tether 14, as shown in FIG. 3, by either yanking on the tether, or be permitting the momentum of the ascending envelope to cause the same to descend the tether. When the envelope reaches its lowest level of descent, the above-described cycle is repeated, thereby providing a child, as schematically represented by the hand 16, with many hours of active amusement and fun.

Figure 4:
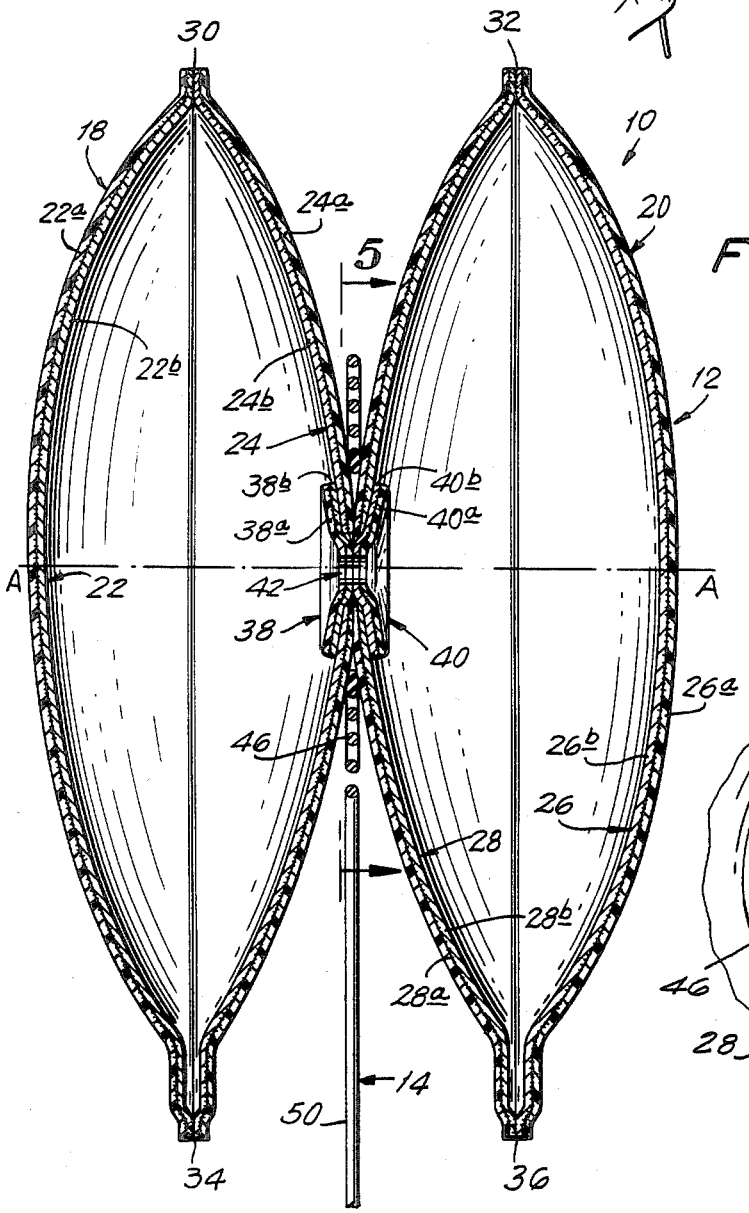
FIG. 4 is an enlarged sectional view taken along line 4—4 of FIG. 1.
Figure 5:
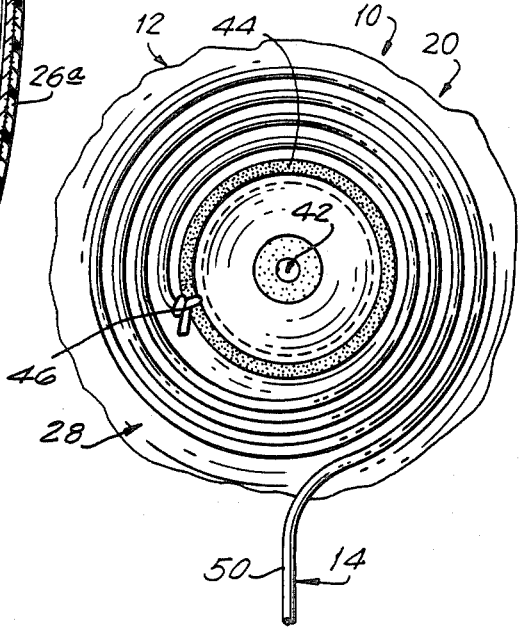
FIG. 5 is an enlarged sectional view taken along line 5—5 of FIG. 4.

Turning to FIG. 4, the envelope 12 comprises a pair of balloon portions 18, 20 which are mutually symmetrically arranged relative to each other. Each balloon portion has an interior filled with a lighter-than-air gas, preferably a helium-containing gas, at about atmospheric pressure. Each balloon portion 18, 20 is comprised of a pair of attached panels which are continuously sealed together along an annular peripheral region. Thus, balloon portion 18 is comprised of panels 22 and 24, and balloon portion 20 is comprised of panels 26 and 28. Each panel is comprised of a non-elastomeric polymer sheet having a continuous metallic coating on one side of the sheet. Preferably, the metallic coating is vapor-deposited on the inner side of the respective sheet. Thus, panels 22, 24, 26, 28 comprise sheets **22*a*, 24*a*, 26*a*, 28*a*, respectively, which, in turn, are respectively coated with vapor-deposited coatings 22*b*, 24*b*, 26*b*, 28*b***. Each panel preferably has a generally circular outline in the lay-flat, two-dimensional or pre-inflated condition of the envelope.

After inflation, the cross-section of the envelope is also circular. A circular peripheral rim seal 30, 32 extends about each balloon portion to seal together the respective pair of panels of each balloon portion. Various sealing techniques may be employed to seal together the panels of each balloon portion. It is currently preferred to use heat-sealing techniques such as jaw-type sealers, impulse-type sealers, hot-wire sealers, etc. In addition, ultrasonic sealing or light sealing, or any other radiant-energy sealing such as laser-energy sealing, dielectric sealing (electronic), induction bonding, or infrared bonding, may be used. Furthermore, other means of sealing the envelope panels can be utilized other than heat sealing, such as, for example, adhesive bonding, solvent sealing, extruded-bead sealing, and hot-melt sealing.

In an advantageous embodiment, each non-elastomeric polymer sheet is selected from polyolefins, polyvinyl chloride, polyesters, polyvinylidene chloride, polyvinyl alcohol, regenerated cellulose, polyurethane, ethylene vinyl acetate copolymer, ionomers, polyamides, and nitrile polymers.

Each metallic coating is continuous over and coextensive with the inner side of each sheet. Each metallic coating is opaque, and has a thickness in the range of from about $1\times10^{-6}$ inch to about $5\times10^{-5}$ inch. Each metallic coating is aluminum, but other malleable common metals such as copper, gold, silver, iron, chromium, nickel and the like could be employed. Aside from vapor deposition, the coating can be formed by vacuum metallizing, vapor-phase deposition, cathode sputtering, or even hand painting.

The envelope 12 has an internal volume of up to about 20 cu. ft. and has a ratio of its volume taken to the two-thirds power to its surface area of from about 0.21 to about 0.01 and an average envelope weight in the range of from about $2.6\times10^{-4}$ gm/cm$^2$ to about $1.7\times10^{-2}$ gm/cm$^2$. The sheet material has a thickness of from about 0.1 to about 6.5 mils.

Rather than a single sheet and a single coating to constitute each panel, other laminate composite constructions may be employed such as a single coating sandwiched between two sheets, or a single sheet sandwiched by two coatings. The resultant composite renders the envelope substantially gas-impermeable and the balloon toy itself substantially permanently air-buoyant. Experience has shown that balloons made with the above-described construction will remain buoyant for an indefinite period of time in excess of about one year, with a potential maximum lifetime exceeding several years. Hence, the balloon can serve not only as a toy, but with appropriate advertising indicia provided and preferably printed on the exterior of the panels, can serve as an advertising balloon.

Referring again to FIG. 4, reference numerals 34, 36 identify inlets or filling nozzles through which the lighter-than-air gas is introduced into the interior of each balloon portion. After such gas filling, the inlets 34, 36 are closed, preferably by heat-sealing techniques. The interiors of each balloon portion communicate with each other through a central opening formed by an attached pair of sealing discs 38, 40 which are provided within the balloon portions 18, 20, respectively. As described below, the discs 38, 40 are sealed to each other, and also are operative to seal the balloon portions to each other. The discs 38, 40 also form a spool 42 around which the tether 14 is coiled and uncoiled about a spool axis A—A during play.

Each sealing disc 38, 40 is annular, and is advantageously made of the same composite material as each aforementioned panel. Thus, disc 38 is comprised of a non-elastomeric polymer sheet 38*a* coated with a vapor-deposited metallic coating 38*b*. Disc 40 is comprised of a non-elastomeric polymer sheet 40*a* coated with a vapor-deposited metallic coating 40*b*. The coating 38*b* faces, and is continuously sealed, preferably by heat sealing along an outer annulus to, the coating 24*b* of the panel 24. The coating 40*b* faces, and is continuously sealed, preferably by heat sealing along an outer annulus to, the coating 28*b* of the panel 28. Both outer annuli have the same diameter, overlie each other, and are in mutual registry. The coatings 38*b*, 40*b* also face, and are continuously sealed, preferably by heat sealing along an inner annulus to, each other. The inner annulus has a diameter which is smaller than that of either outer annulus. Each annulus is concentric with the spool axis.

A band 44, advantageously an elastic band made of rubber, encircles the spool 42 and serves as a convenient mounting structure to which a fastening end region 46 of the tether 14 is tied. The opposite end region 48 of the tether is held in the user's hand. Tether region 50 intermediate the end regions 46, 48 is coiled about and uncoiled from the spool 42 during play, as described below.

More particularly, as shown in FIG. 1, the user initially coils substantially the entire length of the tether region 50 about the spool 42 in one circumferential direction in a manner roughly analogous to winding a yo-yo toy. Thereupon, the lighter-than-air gas-filled envelope is released while, at the same time, the user, of course, holds the end region 48 of the tether. This release enables the envelope 12 to rise. During such ascent, the envelope 12 spins about the spool axis in the circumferential direction of the arrow B and, during this spinning, the tether is uncoiled.

In FIG. 2, the tether has been uncoiled to its maximum length, but the envelope does not stop spinning in the direction of the arrow B and, in fact, the momentum of the spinning envelope causes the envelope to begin to climb down the string to a certain extent and to coil about the spool, which situation is shown in FIG. 3. During this descent of the envelope, the user can raise his or her hand and, in effect, assist the re-coiling of the tether around the spool. In addition, the user can yank the tether at any time, and particularly when the envelope is at the topmost position shown in FIG. 2, and cause the envelope to descend the tether. All of these manipulative actions can be repeated, thereby providing hours of enjoyment.

Other shapes for the panels are, of course, within the spirit of this invention. In fact, an unlimited number of shapes and configurations for the envelope is contemplated.

For even further play value, the tether 14 need not be a string or cord, but can be an elastic or elastomeric tether, so that a bouncing action caused by the stretching and return of the elastic tether can be added to the ascending and descending movement of the envelope.

It will be understood that each of the elements described above, or two or more together, also may find a useful application in other types of constructions differing from the types described above.

While the invention has been illustrated and described as embodied in an ascending and descending balloon action toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An ascending and descending balloon action toy, comprising:

(a) an air-buoyant envelope having an attached pair of mutually symmetrically arranged balloon portions, each having an interior filled with a lighter-than-air gas at about atmospheric pressure;

(b) a spool defining an axis between the balloon portions; and (c) a tether having a fastening end region operatively connected to the spool, an opposite handle end region held by a user during play, and a tether region intermediate the end regions and repeatably coilable around, and uncoilable from, the spool during play, (i) said tether region uncoiling from the spool about the axis when the envelope is released by the user into the air so as to enable ascent of the envelope, (ii) said tether region coiling around the spool about the axis when the handle end region is yanked by the user so as to cause descent of the envelope.

2. The action toy as defined in claim 1, wherein each balloon portion is composed of two attached panels, each panel being comprised of a non-elastomeric polymer sheet having a continuous metallic coating on one side of the respective sheet, said panels being attached to form each balloon portion by continuous seals along peripheral regions of each balloon portion, thereby rendering the envelope substantially gas-impermeable and substantially permanently air-buoyant.

3. The action toy as defined in claim 2, wherein the balloon portions are connected together along an annular seal which constitutes the spool, said spool bounding an interior which communicates with the interiors of both balloon portions.

4. The action toy as defined in claim 3, wherein each polymer sheet has an inner side on which the metallic coating is provided; and wherein the spool includes a pair of juxtaposed sealing discs, each composed of a non-elastomeric polymer sheet coated with a continuous metallic coating; and wherein the metallic coating of one of the discs faces, and is continuously sealed along an inner annulus to, the metallic coating of the other of the discs; and wherein each metallic coating of a respective disc faces, and is continuously sealed along an outer annulus to, a respective metallic coating on the inner side of the polymer sheet of one of the panels of each balloon portion.

5. The action toy as defined claim 4, wherein the inner annulus has a smaller circular cross-section than that of the outer annulus.

6. The action toy as defined in claim 5; and further comprising a band encircling the spool, said fastening end region being attached to the band.

7. The action toy as defined in claim 3; and further comprising a filling nozzle on the envelope and through which the lighter-than-air gas is introduced into the envelope.

8. An ascending and descending balloon action toy, comprising:

(a) a substantially permanently air-buoyant envelope having an attached pair of substantially gas-impermeable, mutually symmetrically arranged, balloon portions having a common interior filled with a lighter-than-air gas at about atmospheric pressure, (i) each balloon portion being composed of two attached panels, each comprised of a non-elastomeric polymer sheet having a continuous metallic coating on an inner side of the respective sheet, said panels being attached to form each balloon portion by continuous peripheral seals along peripheral regions of each balloon portion;

(b) a spool defining an axis between the balloon portions and including a pair of juxtaposed sealing discs, each comprised of a non-elastomeric polymer sheet coated with a continuous metallic coating, (i) said metallic coating of one of the discs facing, and being continuously sealed along an inner annulus to, said metallic coating of the other of the discs, (ii) each metallic coating of a respective disc facing, and being continuously sealed along an outer annulus to, a respective metallic coating on the inner side of the polymer sheet of one of the panels of each balloon portion, (iii) said inner and outer annuli being centered on the axis, and the inner annulus having a smaller diameter than the diameter of the outer annulus; and (c) a tether having a fastening end region operatively connected to the spool, an opposite handle end region held by a user during play, and a tether region intermediate the end regions and repeatably coilable around, and uncoilable from, the spool during play, (i) said tether region uncoiling from the spool about the axis when the envelope is released by the user into the air so as to enable ascent of the envelope, (ii) said tether region coiling around the spool about the axis when the handle end region is yanked by the user so as to cause descent of the envelope.

9. An ascending and descending action balloon, comprising:

(a) an air-buoyant envelope having an attached pair of mutually symmetrically arranged balloon portions, each having an interior filled with a lighter-than-air gas at about atmospheric pressure;

(b) a spool defining an axis between the balloon portions; and (c) a tether having a fastening end region operatively connected to the spool, an opposite handle end region held during use, and a tether region intermediate the end regions and repeatably coilable around, and uncoilable from, the spool during use, (i) said tether region uncoiling from the spool and causing the envelope to spin in one circumferential direction about the axis during ascent of the envelope, (ii) said tether region coiling around the spool and causing the envelope to spin in the opposite circumferential direction about the axis during descent of the envelope.

* * * * *